US006494212B1

(12) United States Patent
Yamakoshi

(10) Patent No.: US 6,494,212 B1
(45) Date of Patent: Dec. 17, 2002

(54) ORNAMENTAL HAIR ENRICHING EQUIPMENT

(75) Inventor: Toshiyuki Yamakoshi, Tokyo (JP)

(73) Assignee: Artnature Inc., Tokyo (JP)

( * ) Notice: Subject to any disclaimer, the term of this patent is extended or adjusted under 35 U.S.C. 154(b) by 0 days.

(21) Appl. No.: 09/477,894

(22) Filed: Jan. 5, 2000

(51) Int. Cl.[7] ..... A41G 3/00
(52) U.S. Cl. ..... 132/53; 132/201; 132/56
(58) Field of Search ..... 132/200, 53, 54, 132/56, 201

(56) References Cited

U.S. PATENT DOCUMENTS

| | | | | | |
|---|---|---|---|---|---|
| 3,645,279 | A | * | 2/1972 | Imre | 132/53 |
| 3,868,959 | A | * | 3/1975 | Koh | 132/53 |
| 4,168,713 | A | * | 9/1979 | Agiotis | 132/53 |
| 4,658,841 | A | * | 4/1987 | Won | 132/53 |
| 4,788,991 | A | * | 12/1988 | Nocera et al. | 132/156 |
| 5,010,914 | A | * | 4/1991 | Merges | 132/54 |
| 6,035,861 | A | * | 3/2000 | Copello | 132/201 |
| 6,220,249 | B1 | * | 4/2001 | Park | 132/53 |

FOREIGN PATENT DOCUMENTS

| | | |
|---|---|---|
| DE | 1935209 | 1/1971 |
| JP | 2-35-22227 | 9/1960 |
| JP | 60-113321 | 7/1985 |
| JP | 62-206006 | 9/1987 |
| JP | 10-77514 | 3/1998 |

* cited by examiner

*Primary Examiner*—Nicholas Lucchesi
*Assistant Examiner*—Robyn Kieu Doan
(74) *Attorney, Agent, or Firm*—Harness, Dickey & Pierce P.L.C.

(57) ABSTRACT

For providing a widely usable ornamental hair enriching equipment easy to rake out original hairs and capable of use for a multiple of heads, the ornamental hair enriching equipment comprises a support member made in a manner that an ventilation member with fine meshes is wound on a slightly stiff tape member, fastenings of reversible comb-like clips disposed on the back surface of the support member, a plurality of parallel elastic linear members comprising inside elastic bodies made of hard resin or steel material with adequate elasticity and stiffness, and formed to have a circular arc with a large curvature so as to fit to the curved surface of a general human head, and ventilation members made of tubes with fine meshes, and fitted outside the elastic bodies to engage integrally therewith, supported by the support member at one end of each of them, and disposed on the support member at predetermined intervals, and artificial hairs implanted on at least the elastic linear members. The ornamental hair enriching equipment is worn on a head by the fastenings such that the extension direction of the elastic linear members is along the hair flow direction of original hair.

17 Claims, 6 Drawing Sheets

ORNAMENTAL HAIR ENRICHING EQUIPMENT

BACKGROUND OF THE INVENTION

1. Field of the Invention

The present invention relates to an ornamental hair enriching equipment hardly restricted in attachment position to a head and easy to arrange complex hair of original and artificial hairs.

2. Description of the Related Art

Hitherto, there are hair enriching equipments in which artificial hair (that artificial or natural hairs have been processed) is attached to a human head, and united together with his or her thin original hair (natural hair growing on his or her head) to make it look like his or her original hair having increased.

Besides, there are ribbons, barrettes, beads, etc., for adorning human heads gaily. In recent years, there are ornamental equipments such as partial wigs and false hairs for producing head adornment by dyeing his or her original hair into a color impossible naturally, or mixing artificial hair of such a color with his or her original hair.

FIG. 6 is a rear view of a hair enriching equipment (wig for hair enrichment) used for hair enrichment as a principal object. The hair enrichment wig 1 shown in the drawing is made in a manner that artificial hairs 3 are implanted to a flexible ventilation (implantation) member 2 with meshes of very large size, e.g., 3 cm square. The ventilation member 2 is fixed to the original hair of a wearer by a suitable method, the artificial hairs 3 are raked away from the above, and original hairs pressed down due to the wear of this hair enrichment wig 1 and lying down under it, are raked out through the meshes with a comb or a brush, and united together with the neighboring artificial hairs 3 to arrange hair.

While the mesh of the ventilation member of a wig is generally very minute, e.g., 1 mm square, the mesh as described above is large because the equipment is made for a person who has relatively rich original hair and is not discomforted even by a small quantity of implanted artificial hairs 3, and because it is formed such that a large quantity of original hairs can easily be raked out.

But, when a person wears it actually and tries to rake out his or her original hairs, teeth of a comb or tips of a brush may be caught by meshes though the meshes are made into a fairly large size, so he or she can not rake out his or her original hairs as he or she wishes. Even when he or she catches his or her original hairs by teeth of the comb or tips of the brush with much effort and is going to rake out them, there may then arise a trouble that the original hairs are caught by meshes and they are only swell in a loop shape and do not easily come out.

Consequently, when such a hair enriching equipment is worn, the wearer must ask an experienced technical expert to rake out his or her original hairs. This was troublesome and dissatisfactory to the wearer of the hair enriching equipment.

FIG. 7 is a rear view of a wig for thin-haired head (wig for hair enrichment) proposed to solve the above problem. The hair enrichment wig 5 shown in the drawing is made by the manner that a plurality of parallel linear members 7 made of a shape memory alloy is attached to an annular base 6, and artificial hairs 8 are implanted on the linear members 7.

In this construction, when a person wears the hair enrichment wig 5 on his or her head and rakes out his or her original hairs, the original hairs are easily to come out merely by moving teeth of a comb or tips of a brush along the linear members 7.

However, when the above hair enrichment wig 5 is actually made and worn by way of experiment, though original hairs are easy to be raked out in the central portion of the annular base 6, linear members 7 are short near both sides of the annular base 6, as a result, there arose the same trouble as that in the hair enrichment wig 1 shown in FIG. 6.

Besides, because the base is limited to such an annular shape, that is, because the curved portion (R: curved shape) of the base that is the engagement portion with a head in wear, is defined, the use portion to the head is restricted and it is hard to use it on different sizes or shapes of the heads. Besides, for using a shape memory alloy for the linear members, an individual wig must be made so as to correspond to the shape of the head of the user of the wig. Consequently, a stock of the wig can not be made as products for wide use. That is, troublesome expensive products at special orders can be supplied only.

SUMMARY OF THE INVENTION

It is an object of the present invention to provide a widely usable ornamental hair enriching equipment easy to rake out original hairs and capable of use for a multiple of heads.

Hereinafter, constructions of ornamental hair enriching equipments according to the present invention will be described.

An ornamental hair enriching equipment according to the present invention for use for personal adornment in the manner that artificial hairs of a different color is mixed with original hairs, or for use for hair enrichment in the manner that artificial hairs of the same color as that of original hair is mixed with the original hair having thinned, comprises a plurality of fastenings, a support member provided with said fastenings, a plurality of parallel elastic linear members supported by said support member at one end of each of them and disposed on said support member at predetermined intervals, and artificial hairs implanted on at least the above elastic linear members.

Besides, an ornamental hair enriching equipment according to the present invention for use for personal adornment in the manner that artificial hairs of a different color is mixed with original hairs, or for use for hair enrichment in the manner that artificial hairs of the same color as that of original hair is mixed with the original hair having thinned, comprises a plurality of fastenings, a plurality of support members provided with said fastenings, a plurality of parallel elastic linear members supported by said plurality of support members at both ends of them and disposed on said plurality of support members at predetermined intervals, and artificial hairs implanted on at least the above elastic linear members. The above plurality of elastic linear members may be supported by one support member at its one end, and divisionally supported by a plurality of support members at its other end.

The above plurality of elastic linear members may be disposed such that the end of the end portion supported by the above support member protrudes outward beyond the above support member, and may have a curved shape corresponding to the curved surface of a human head, and a laterally winding shape along the curved surface of the human head.

BRIEF DESCRIPTION OF THE DRAWINGS

FIGS. 5A and 5B are views showing another example of elastic linear members, in which FIG. 5A is a plan view and FIG. 5B is a side view thereof;

DETAILED DESCRIPTION OF THE PREFERRED EMBODIMENTS

Hereinafter, embodiments of ornamental hair enriching equipments according to the present invention will be described with reference to drawings.

Figure 1:
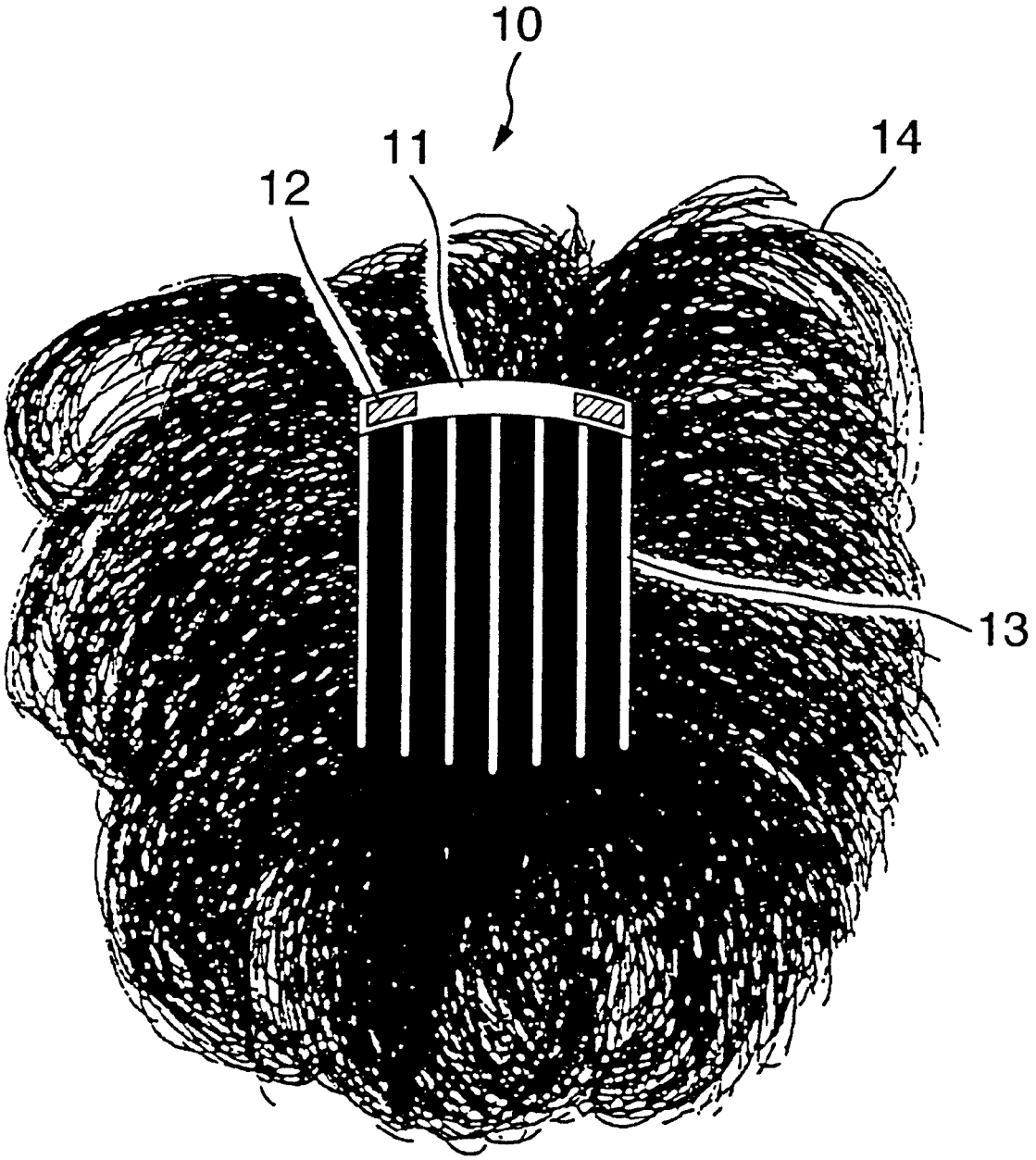
FIG. 1 is a rear view of an ornamental hair enriching equipment according to a first embodiment of the present invention.

FIG. 1 is a rear view of an ornamental hair enriching equipment according to a first embodiment of the present invention. As shown in the drawing, the ornamental hair enriching equipment 10 comprises a support member 11, fastenings 12 attached to the back surface of the support member 11, a plurality of elastic linear members 13 supported by the support member 11 at one end of each of them, and artificial hairs 14 implanted on at least the above elastic linear members 13. The above artificial hairs 14 may be implanted on the support member 11.

Figure 2A:
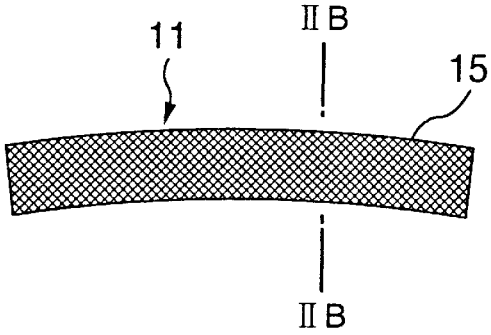
FIGS. 2A to 2H are views showing components of the ornamental hair enriching equipment individually.
Figure 2B:
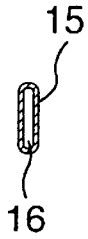

FIGS. 2A to 2H are views showing the components of the ornamental hair enriching equipment 10 individually. FIG. 2A is a plan view of the support member 11, and FIG. 2B is a sectional view taken along line IIB—IIB thereof. As shown in FIGS. 2A and 2B, the support member 11 is made into a long and narrow sheet substantially rectangular in the manner that an ventilation member 15 with fine meshes is wound on a slightly stiff tape member 16. Of course, without the tape member 16, only the ventilation member 15 may be folded several times to form such a long and narrow rectangular sheet.

Figure 2C:
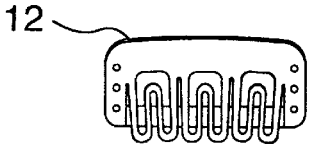

FIG. 2C shows one of the fastenings 12 attached to both ends in the longitudinal direction of the above support member 11, which is shown in an enlarged form so as to be easy to understand. The fastening 12 shown in FIG. 2C is a reversible comb-like clip. Of course, the fastening is not limited to this, but may be one of another shape if it can fix the support member 11 to original hair. Besides, the attachment positions are also not limited to both ends, and, the number of fastenings is also not limited to two.

Figure 2D:
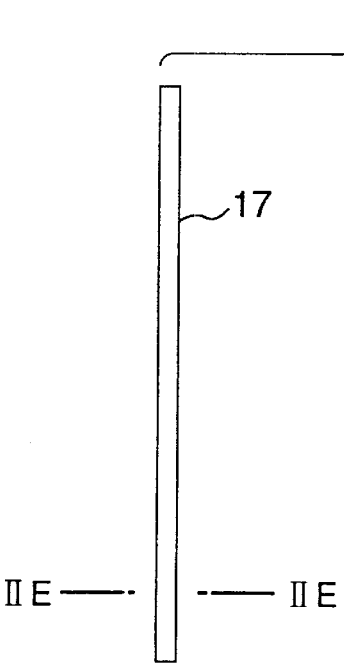
Figure 2F:
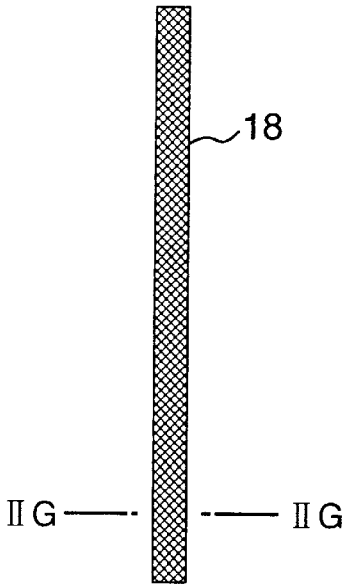
Figure 2H:
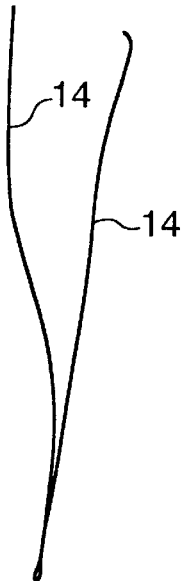
Figure 2E:
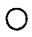
Figure 2G:
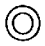

FIGS. 2D to 2G are exploded views of an elastic linear member 13, in which FIG. 2D shows an elastic body 17 in the elastic linear member 13, FIG. 2E shows a sectional view taken along line IIE—IIE thereof, and FIGS. 2F and 2G show an ventilation member 18 outside the elastic linear member 13. The elastic body 17 shown in FIG. 2D is made of a hard resin or a steel material with adequate elasticity and stiffness, and is formed in advance to have a circular arc with a large curvature so as to fit to the curved surface of a general human head (in FIG. 2D, since it is curved from the front side to the opposite side, it appears as a straight form in the drawing).

The ventilation member 18 shown in FIGS. 2F and 2G is made of a tube with fine meshes. It is fitted outside the elastic body 17 and engaged with the elastic body 17 into one body. In this state, as shown in FIG. 1, the elastic linear members 13 are supported by the support member 11 at one end of each of them, and arranged on the support member 11 at predetermined intervals.

FIG. 2H shows an artificial hair 14. The artificial hair 14 is made of, e.g., a nylon filament or the like with adequate fineness, and can be colored into a desired color by original coloring or dyeing. These artificial hairs 14 are implanted on the ventilation member 15 of the support member 11 and the ventilation member 18 of each elastic linear member 13.

When the ornamental hair enriching equipment 10 shown in FIG. 1 thus constructed is worn to a head, it is fixed to the original hairs on the upstream side of the hair flow with the fastenings 12 such that the extension direction of the elastic linear members 13 is directed to the downstream side of the hair flow. Then, by raking up hairs once in the reverse direction of the hair flow with a comb or a brush along the hair flow, that is, along the extension direction of the elastic linear members 13, original hairs are easily raked out. Then, by combing hair in the direction of the hair flow along the hair flow, the raked-out original hairs are naturally mixed with the artificial hairs 14.

The elastic linear members 13 of this ornamental hair enriching equipment 10 retain their shapes even in combing and in use because of the inside elastic bodies 17 with adequate elasticity and stiffness, so the ornamental hair enriching equipment 10 can be worn comfortably. Besides, since the base portion consisting of the support member 11 and the elastic linear members 13 does not include any annular attachment portion that restricts the attachment position, it can fit any portion of a head. Consequently, the ornamental hair enriching equipment good for use for a multiple of heads can be obtained.

In the above example, a single support member 11 is provided on the upstream side of the hair flow, and each elastic member 13 whose one end is fixed to the support member 11 is free at the other end. But, the other end may be fixed to another support member. This will be described below as another embodiment.

Figure 3:
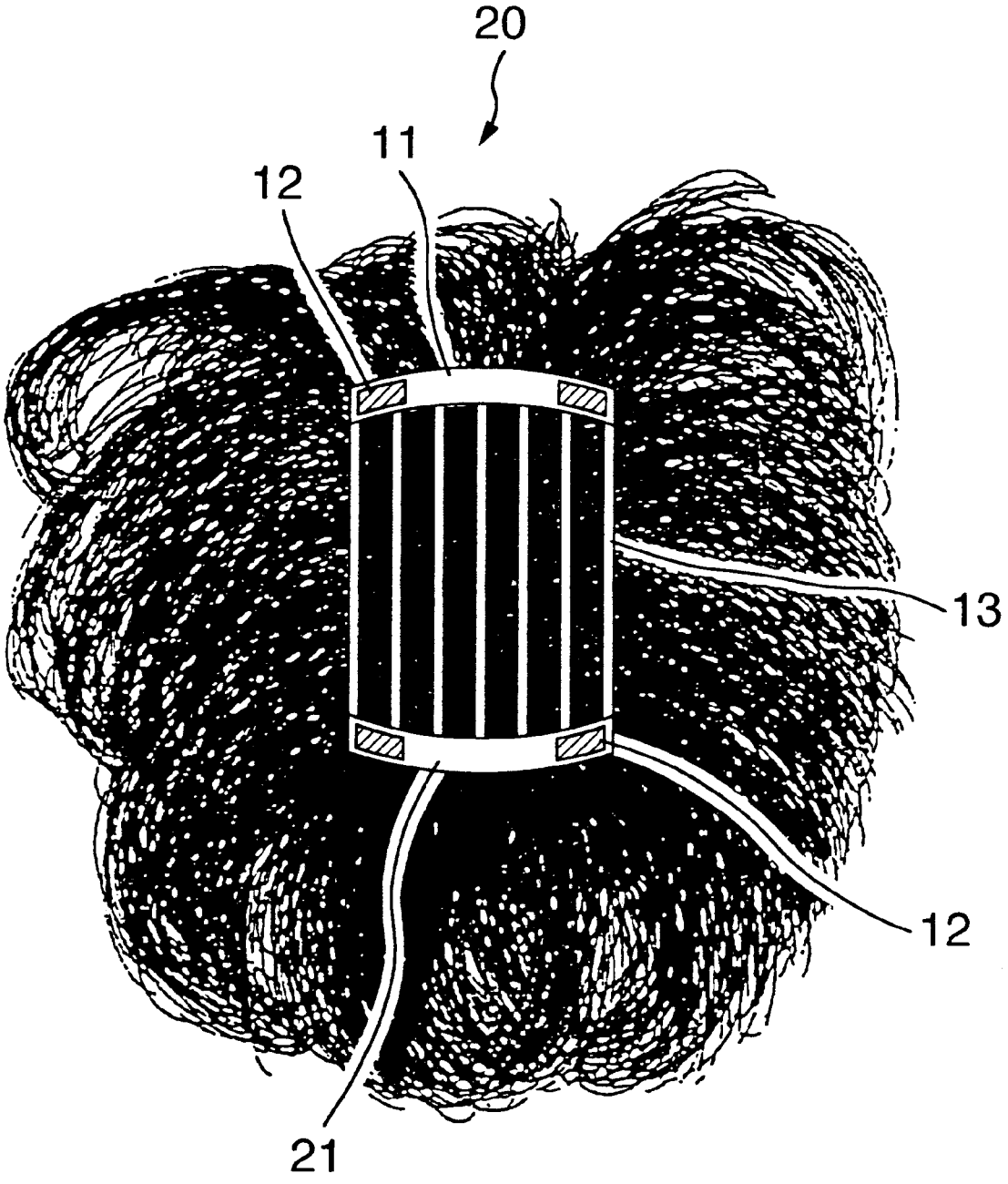
FIG. 3 is a rear view of an ornamental hair enriching equipment according to a second embodiment of the present invention.

FIG. 3 is a rear view of an ornamental hair enriching equipment according to the second embodiment of the present invention. As shown in the drawing, this ornamental hair enriching equipment 20 comprises a support member 11 like the case of the ornamental hair enriching equipment 10 shown in FIG. 1, fastenings 12 attached to the back surface of the support member 11, and a plurality of elastic linear members 13 supported by the support member 11 at one end of each of them. In this case, the other end of each elastic linear member 13 that is free in case of the ornamental hair enriching equipment 10 shown in FIG. 1, is fixed to another support member 21. An adequate number of fastenings 12 are attached also to this support member 21.

The ornamental hair enriching equipment 20 thus constructed is easier to handle because the relative positions of the elastic linear members 13 are fixed. Besides, even if the support member 21 is provided on the downstream side of the hair flow in this manner, since the elastic linear members 13 are enough long, enough long gaps in the hair flow direction can be formed between them for combing for raking out original hairs. Consequently, the support member 21 on the downstream side does not prevent the combing operation of a comb or a brush.

Figure 4A:
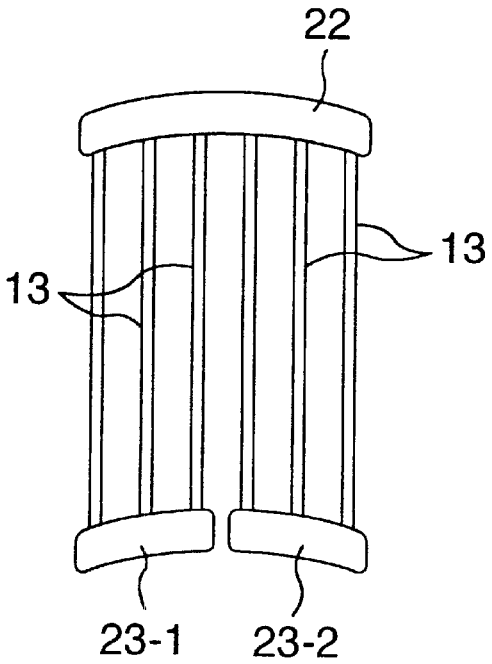
FIGS. 4A and 4B are views typically showing only the base portions of support members and elastic linear members according to modifications of the second embodiment.
Figure 4B:
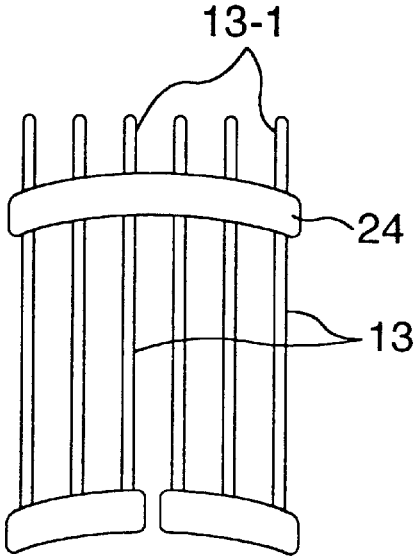

FIGS. 4A and 4B show modifications of the above ornamental hair enriching equipment 20, and are views typically showing only the base portions of the support members and the elastic linear members. In the base portion shown in FIG. 4A, a plurality (six) of elastic linear members 13 are supported by a single support member 22 at one end of each elastic linear member 13. The other ends of the elastic linear members 13 are supported by a plurality (two) of support members 23-1 and 23-2 with being divided into three and three. By thus forming the base portion of the ornamental hair enriching equipment 20, the ornamental hair enriching equipment good for retaining its shape and with a greater degree of freedom can be obtained.

In the base portion shown in FIG. 4B, the plurality of elastic linear members 13 shown in FIG. 4A are disposed such that the distal ends 13-1 of the end portions supported by the support member 24 protrude outward beyond the support member 24. With such a base portion, for example, by attaching the ornamental hair enriching equipment so as to dispose the portion that the ends 13-1 of the elastic linear members 13 protrude, near a hairline, e.g., on the forehead, and raking out forward both the original and artificial hairs in the front half of the whole, the support member 24 is not conspicuous even in case of a person with thin original hair.

The elastic linear members 13 are not limited to the feature of protruding outward only beyond the support member 24. For example, they may protrude outward beyond the support members 23-1 and 23-2 of FIG. 4A. Further, also in cases of the support member 11 in FIGS. 1, 2A, and 2B, or the support member 21 in FIG. 3, the ends 13-1 of the elastic linear members 13 may protrude outward beyond it.

Figure 5A:
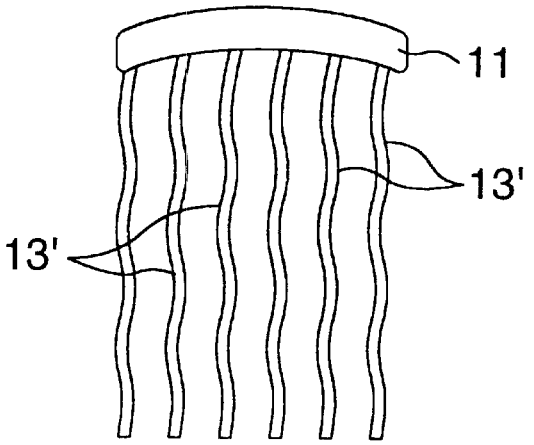
Figure 5B:
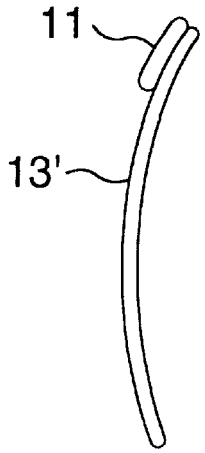
Figure 6:
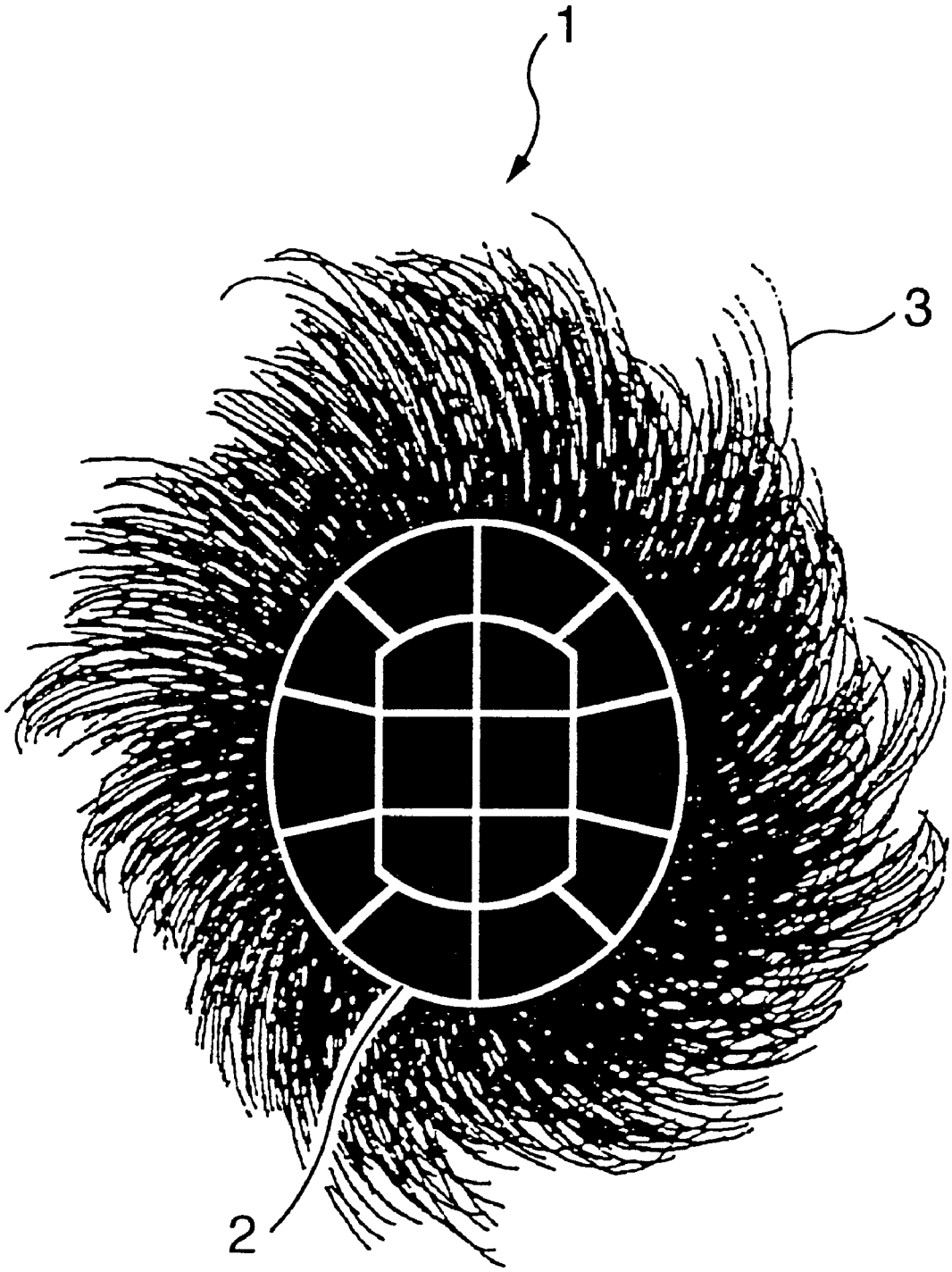
FIG. 6 is a rear view of a conventional hair enriching equipment used for hair enrichment as a principal object.
Figure 7:
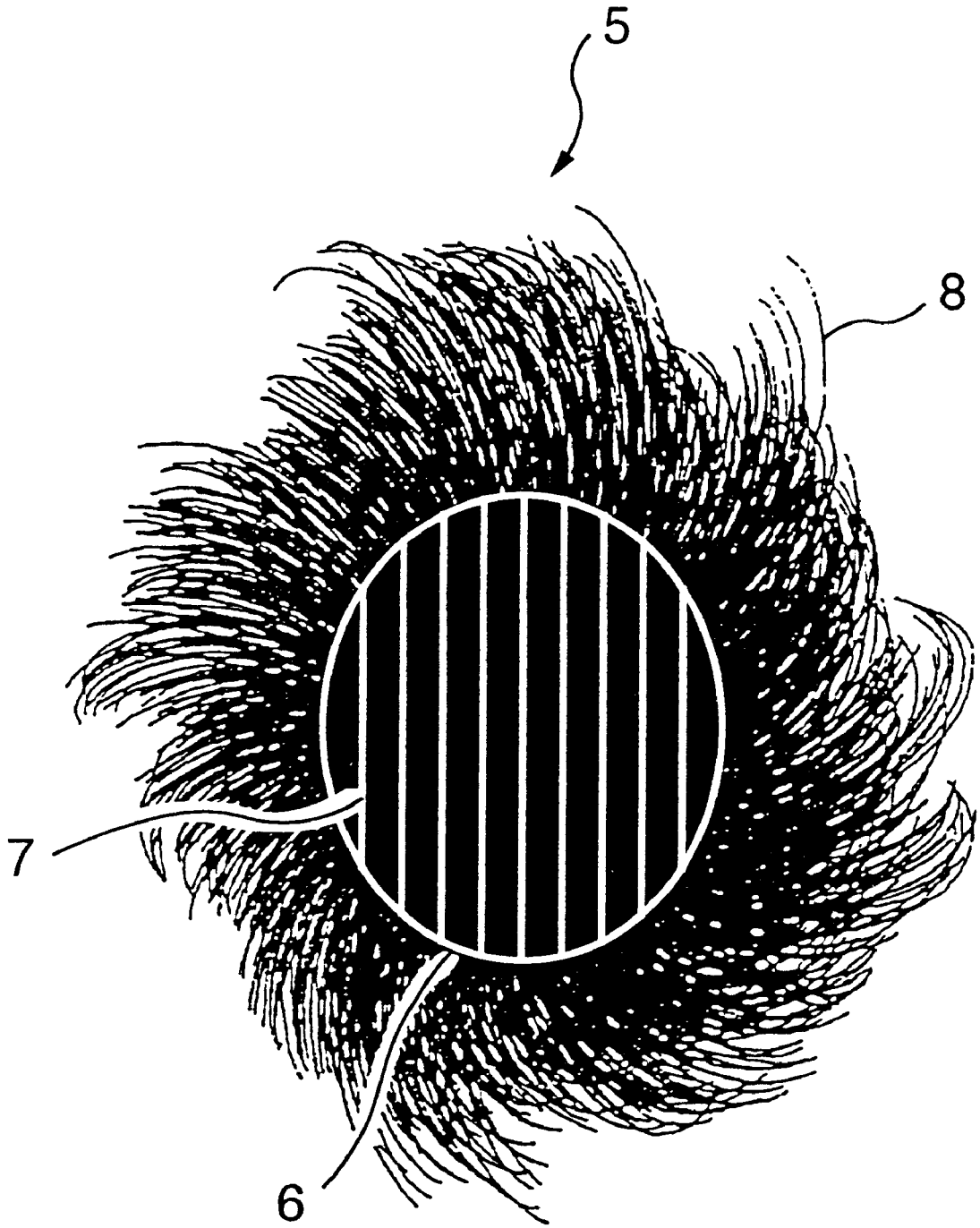
FIG. 7 is a rear view of a conventional wig for thin-haired head proposed as one easy to rake out original hairs.

FIGS. 5A and 5B are views showing another example of elastic linear members, in which FIG. 5A is a plan view and FIG. 5B is a side view thereof. These elastic linear members 13' are supported by a support member 11 at one end of each of them. As shown in FIG. 5B, each elastic linear member 13' has a curved shape corresponding to the curved surface of a human head like the case of the elastic linear members 13 of FIGS. 1 to 4A and 4B, and, as shown in FIG. 5A, a laterally winding shape along the curved surface of the human head. Also in this case, by wearing the equipment so as to make the extension direction of the winding elastic linear members 13' coincide to the hair flow of the head, and combing with a comb or a brush, original hairs can easily be raked out because there is nothing to interrupt the hair flow.

Besides, since artificial hairs are implanted on the thus laterally winding elastic linear members 13', the artificial hairs are not unnaturally apart but can mix with original hairs properly. Also in this case, both ends of the elastic linear members 13' may be supported by the support members, as shown in FIG. 3. Besides, as shown in FIG. 4A, the other ends thereof may be divided so as to be supported by the respective support members. Further, one end or both ends of each elastic linear member 13' may protrude outward beyond the support members, as shown in FIG. 4B.

As described above in detail, according to the present invention, since an equipment for personal adornment or for hair enrichment is made in the manner that artificial hairs are implanted on rectangular fastenings and a plurality of parallel elastic members disposed in a direction perpendicular to the fastenings, there is required no annular fixture portion like the prior art that restricts the attachment position. Consequently, it can be naturally attached to almost any portion of a head. This makes it possible to stock them for wide use and immediately to react to comply with a customer's request.

Besides, since there is nothing, except fastenings, in a direction along the hair flow to interrupt the hair flow, merely by operating a comb or a brush along the hair flow, original hairs can be easily raked out and mixed with artificial hairs to comb hair. Accordingly, it is less troublesome to handling and so convenient.

What is claimed is:

1. An ornamental hair enriching equipment for use for personal adornment in a manner that artificial hairs of a different color is mixed with original hairs, or for use for hair enrichment in a manner that artificial hairs of the same color as that of original hair is mixed with the original hair having thinned, comprising:

a plurality of fastenings;

a single longitudinally extending support member provided with said fastenings;

a plurality of parallel elastic linear members supported by said support member generally at one end of each of them and disposed on said support member at predetermined intervals and extending substantially perpendicularly to the longitudinal direction of said single support member, said elastic linear members being generally separated from each other beyond said one end; and artificial hairs implanted on at least said elastic linear members.

2. An ornamental hair enriching equipment for use for personal adornment in a manner that artificial hairs of a different color is mixed with original hairs, or for use for hair enrichment in a manner that artificial hairs of the same color as that of original hair is mixed with the original hair having thinned, comprising:

at least a pair of support members arranged substantially parallel to each other;

a plurality of fastenings provided on said support members;

a plurality of parallel elastic linear members supported at both ends of them by said support members and disposed on said support members at predetermined intervals and in a direction substantially perpendicular to a longitudinal direction of said support members; said elastic linear members being generally separated from each other between said support members; and artificial hairs implanted on at least said elastic linear members.

3. An ornamental hair enriching equipment according to claim 2, wherein said plurality of elastic linear members are supported by one of said support members at one end, and divisionally supported by others of said support members at another end, respectively.

4. An ornamental hair enriching equipment according to claim 2, wherein said plurality of elastic linear members are disposed such that distal ends of end portions supported by said support member protrude outward beyond said support member.

5. An ornamental hair enriching equipment according to claim 3, wherein said plurality of elastic linear members are disposed such that distal ends of end portions supported by said support member protrude outward beyond said support member.

6. An ornamental hair enriching equipment according to claim 1, wherein said plurality of elastic linear members has a curved shape corresponding to the curved surface of a human head, and a laterally winding shape along the curved surface of the human head.

7. An ornamental hair enriching equipment according to claim 2, wherein said plurality of elastic linear members has a curved shape corresponding to the curved surface of a human head.

8. An ornamental hair enriching equipment according to claim 3, wherein said plurality of elastic linear members has a curved shape corresponding to the curved surface of a human head.

9. An ornamental hair enriching equipment according to claim 4, wherein said plurality of elastic linear members has a curved shape corresponding to the curved surface of a human head.

10. An ornamental hair enriching equipment according to claim 5, wherein said plurality of elastic linear members has a curved shape corresponding to the curved surface of a human head.

11. An ornamental hair enriching equipment according to claim 7, wherein said plurality of elastic linear members have a laterally winding shape along the curved surface of the human head.

12. An ornamental hair enriching equipment according to claim 8, wherein said plurality of elastic linear members have a laterally winding shape along the curved surface of the human head.

13. An ornamental hair enriching equipment according to claim 9, wherein said plurality of elastic linear members have a laterally winding shape along the curved surface of the human head.

14. An ornamental hair enriching equipment according to claim 10, wherein said plurality of elastic linear members have a laterally winding shape long the curved surface of the human head.

15. An ornamental hair enriching equipment for use for personal adornment in a manner that artificial hairs of a different color is mixed with original hairs, or for use for hair enrichment in a manner that artificial hairs of the same color as that of original hair is mixed with the original hair having thinned, comprising:

a plurality of fastenings;

a plurality of support members provided with said fastenings;

a plurality of parallel elastic linear members supported by said plurality of support members at both ends of them and disposed on said plurality of support members at predetermined intervals; artificial hairs implanted on at least said elastic linear members, said plurality of elastic linear members being supported by one of said support members at one end, and divisionally supported by others of said support members at another end, respectively;

said elastic linear members being generally separated from each other between said support members, said plurality of elastic linear members being disposed such that distal ends of end portions supported by said support member protrude outward beyond said support member.

16. An ornamental hair enriching equipment according to claim 15, wherein said plurality of elastic linear members has a curved shape corresponding to the curved surface of a human head, and a laterally winding shape along the curved surface of the human head.

17. An ornamental hair enriching equipment according to claim 15, wherein said plurality of elastic linear members has a curved shape corresponding to the curved surface of a human head.

* * * * *